United States Patent [19]

Koltz

[11] Patent Number: 4,470,540

[45] Date of Patent: Sep. 11, 1984

[54] OPEN TOP SET UP CONTAINER

[76] Inventor: I. Morton Koltz, 1329 Steeles Ave., W., TH#4, Willowdale, Ontario, Canada, M2R3N2

[21] Appl. No.: 213,866

[22] Filed: Dec. 8, 1980

[51] Int. Cl.[3] ..... B65D 5/36; B65D 5/42

[52] U.S. Cl. ..... 229/41 C

[58] Field of Search ..... 229/24, 41 C, 41 D

[56] References Cited

U.S. PATENT DOCUMENTS

| | | | |
|---|---|---|---|
| 1,555,054 | 9/1925 | Berkowitz | 229/41 C |
| 1,892,715 | 1/1933 | Wellman | 229/41 C |
| 2,499,780 | 3/1950 | Rattman | 229/41 C |
| 2,922,562 | 1/1960 | Pellaton | 229/41 C |
| 3,861,582 | 1/1975 | Back | 229/41 B |
| 4,079,853 | 3/1978 | Casutt | 229/41 B |
| 4,134,531 | 1/1979 | Martinez | 229/41 C |

FOREIGN PATENT DOCUMENTS

| | | | |
|---|---|---|---|
| 231119 | 3/1925 | United Kingdom | 229/41 C |

*Primary Examiner*—Herbert F. Ross

*Attorney, Agent, or Firm*—Sheldon H. Parker

[57] ABSTRACT

A blank capable of rapidly setting-up into a self-supporting container, having a polygonal base panel with n sides, wherein n is at least 6, and at least n+2 side panels. The side panels are divided into a first contiguous group and a second contiguous group, with each of the side panels being separated from the contiguous side panel by a fold line. Locking tabs are used to lock the container in the set up position. Due to the multi-sided structure an ease of assembly as well as a ridigity not found in the prior art is provided.

14 Claims, 8 Drawing Figures

Fig. 5
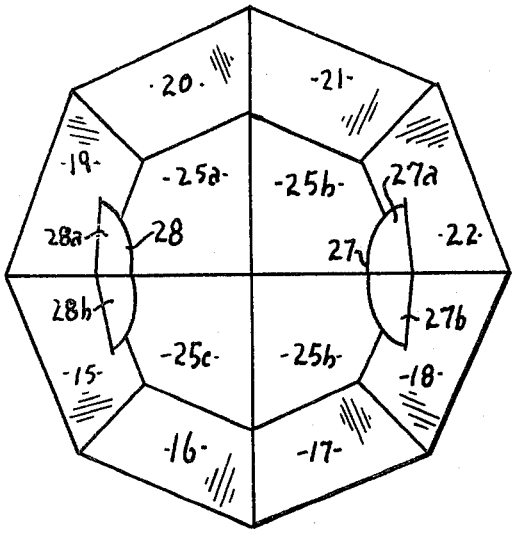
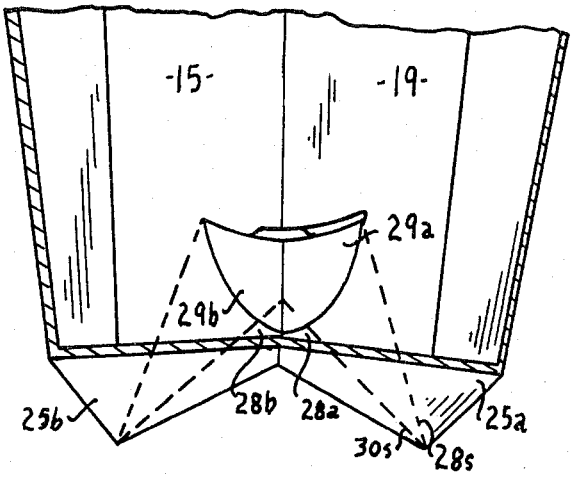
Fig. 7
Fig. 3
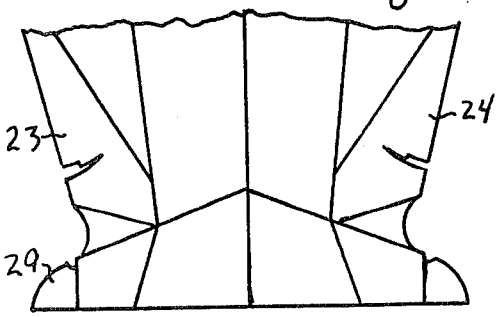
Fig. 8
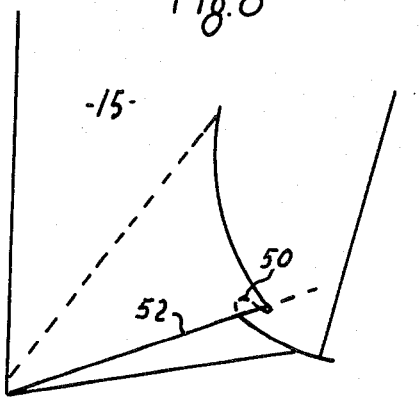

OPEN TOP SET UP CONTAINER

CROSS REFERENCE TO RELATED APPLICATION

This is related to subject matter disclosed in patent application Ser. No. 179,739 that although structurally different from the device disclosed in the prior application, the prior application discloses information, definitions and explanations which are pertinent with respect to the present invention and for this reason the subject matter of the prior application is incorporated herein by reference.

BACKGROUND OF THE INVENTION

Brief Description of the Prior Art

Many containers have been designed attempting to perfect the collapsible bucket style container having a multiplicity of sides, ranging from five to circular.

The octagonal and circular "bucket" configurations have received the most attention and success to date, however, there have been basic compromises. The bucket used to contain food, such as fried chicken or popcorn has generally been of a non-collapsible configuration, allowing for the permanent sealing of the seams at the base and sides to prevent leakage.

The collapsible buckets never gained popularity with food related products because of the obvious problems of strength and sealage.

In U.S. Pat. No. 3,827,623, a collapsible circular container is disclosed. As illustrated in FIGS. 4 and 5, the latching tongue 23 locks into the latching aperature 59 with the bottom panels being folded thereon. The bottom seal of this container does not prevent leakage and can safely be used for dry foods only.

The container of U.S. Pat. No. 2,787,408 appears to overcome the aforenoted problem of leakage, however, the strength of the container is not equal to that of the instant invention. The container is glued to appear much like a paper bag when unopened. To secure the container in the open position, the "lower ends of . . . two walls 14, 15, will snap inwardly toward each other at points 11 . . . ". Although there is a snapping action, there is no locking action to prevent the lower ends of the wall from returning to the unfolded position. This would preclude this container from being used with heavy items such as chicken or the like and could pose some problems with items such as popcorn where there is frequent pressure at the bottom.

U.S. Pat. No. 3,809,310 discloses a hexagonal container which, to complete the bottom seal, requires adhesive coated portions. This adds additional expense to the manufacturing through adhesive and additional equipment. In addition the top portion of the container is required to add to the rigidity of the carton, therefore limiting its uses.

BRIEF DESCRIPTION OF THE DRAWINGS

The advantages of the instant invention will become more apparent when the specification is read in conjunction with the drawings wherein:

FIG. 3 is a plan view of the folded blank of FIG. 2;

FIG. 5 is a top view of the inside of the assembled bucket;

FIG. 7 is a side view of the assembled bucket, partially in phantom; and

FIG. 8 is a perspective view of the web mechanism of the instant invention.

DESCRIPTION OF THE INVENTION

Figure 1:
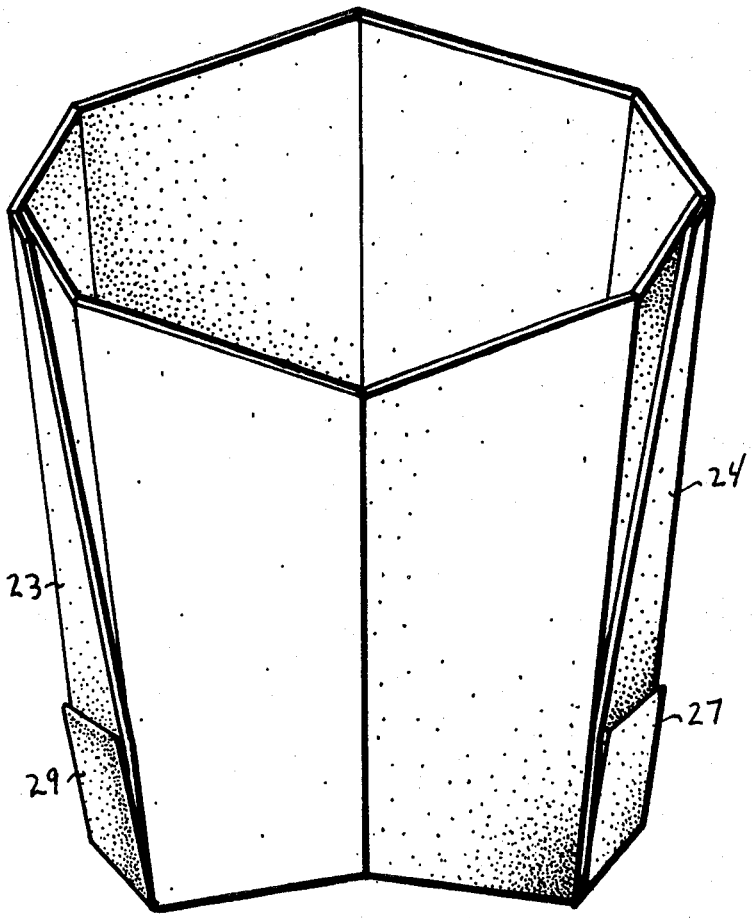
FIG. 1 is a side view of the assembled bucket of the instant invention.

FIG. 1 illustrates the assembled bucket 10 of the instant invention. The tabs 27 and 29 are folded into the interior of the bucket 10 with the tab panels **26*b* and 28*b* folded neatly against the glue panels 23 and 24** respectively.

Figure 2:
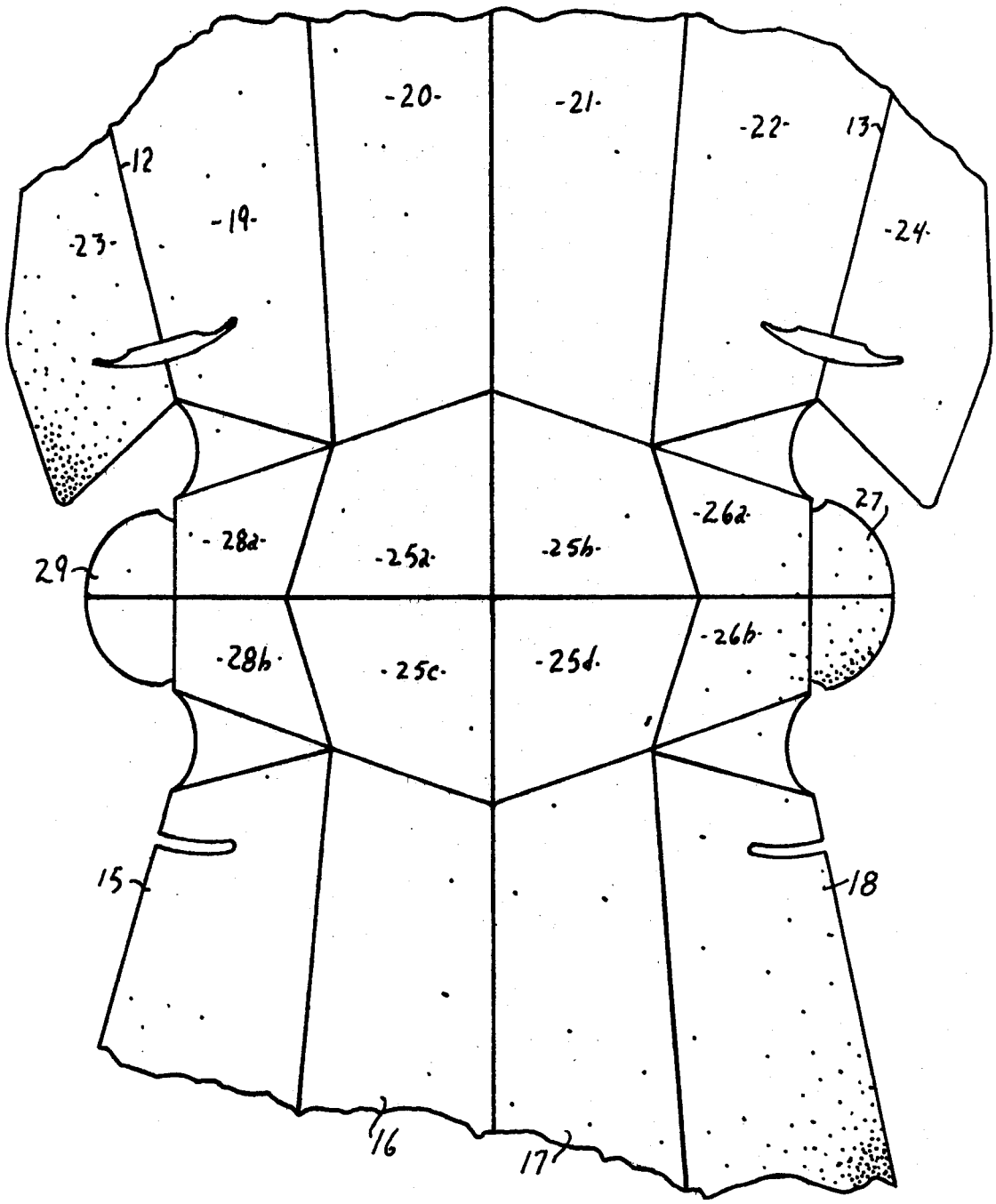
FIG. 2 is a plan view of the blank of the instant invention.

FIG. 2 shows the bottom portion of the unassembled blank of the preferred embodiment. The wall forming side panels 15, 16, 17, 18, 19, 20, 21 and 22 are divided into two equal sized halves, 15, 16, 17 and 18; 19, 20, 21 and 22. The panels 15–22 are of essentially equal widths throughout their length with the inside ends of center panels 16, 17, 20 and 21 angled to correspond to the bottom or base octagon panel 25 and end panels 15, 18, 19 and 22 angled to correspond to webs **30*a*, 30*b*, 30*c* and 30*d*. The outer edge or periphery 40 of the panels 15–22 can be straight, angled or in a decorative pattern corresponding to the contents or exterior picture as required by the aesthetics of the system. The panels 16, 17, 20 and 21 inner edge or periphery is divided from the bottom octagon 25 by fold lines 16L, 17L, 20L and 21L**.

The bottom octagon 25 is divided into four equal octagonal sections **25*a*, 25*b*, 25*c* and 25*d* by intersecting fold lines 34 and 35. The fold lines 34 and 35** allow for the snap closure effect which is explained hereinafter.

Glue panels or glue flap end members 23 and 24 lie next to the panels 19 and 22 and are folded at time of manufacture at fold lines 12 and 13. They are then placed over end panels 15 and 18 and sealed by means well known in the prior art. The fold lines 12 and 13 must align with the outer edges of the panels 15 and 18. The coordinated dimensioning of parts is critical for the container to assemble and open properly.

Adjacent to panels 19, 22, 15 and 18, and connected by fold lines, are, respectively, linking or support webs **30*c*, 30*b*, 30*d* and 30*a*. The webs 30*a*, 30*b*, 30*c* and 30*d* form the separation area between the panels 19, 22, 15 and 18 and the tab panels 28*a*, 26*a*, 28*b* and 26*b* respectively. The webs are used not only for linking purposes but also provide structural support. At the time of opening the bucket 10, the webs 30*a*, 30*b*, 30*c* and 30*d* allows the tab panels 28*a*, 28*b*, 26*a* and 26*b* to be folded flush against the panels 23, 19, 22 and 24. The locking action of the snap lock bottom and locking tabs 29 and 27** will be seen in further detail hereinafter.

The tab slots **32*a* and 32*b* are cut from sections of panels 23, 19, 22 and 24 respectively. Corresponding tab cuts 33*a* and 33*b* are cut in panels 15 and 18 respectively. The tab cuts 33*a* and 33*b* must be positioned to correspond to the portions of the tab slots 32*a* and 32*b* which lie in glue panels 23 and 24** respectively. The necessity of this will become apparent hereinafter.

FIG. 3 shows the bucket 10 folded at fold line 34 and glued along glue panels 23 and 24. The criticality of the placement of tab slots **32*a* and 32*b* and tab cuts 33*a* and 33*b*** is now evident. As seen herein when the glue panels 23 and 24 are folded at fold lines 12 and 14, they overlie panels 15 and 18 respectively. It is therefore critical that the portion of the tab slots 32*a* and 32*b* which overlie the tab cuts 33*a* and 33*b* in panels 15 and 18 be properly aligned so as to enable the tabs 29 and 27 to be properly inserted.

Figure 4:
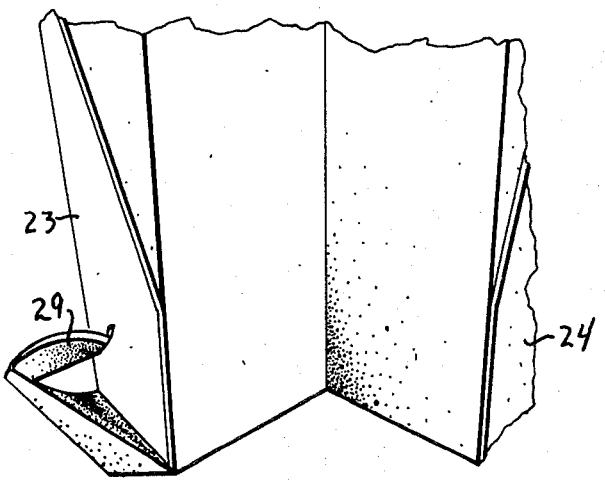
FIG. 4 is a perspective view of the tab locking device of the instant invention.

FIG. 4 shows the open bucket 10 with the tab 29 ready for insertion into tab slot 32*a*. It is seen herein how the web 30*d* folds inward and allows the tab panel 28*b* to fold flush with the glue panel 23. Although this could be obtained by omiiting the web 30*d* completely, it would cut down the strength and rigidity of the bucket 10 and permit fluid leakage at point 42, while providing no advantage either financial or ease of manufacture. Although fold line 34 continues horizontally through the carton bottom, the direction in which it is folded reverses at the tab 29. Due to the angled position of the tab slot 32*a*, caused by the basic construction of the bucket 10, the tab 29 must be folded opposite that of the main container. This can be easily done when the tab 29 is folded at fold line 13*a* by simply pushing toward the base of the carton at fold line 34. The position automatically reverses, allowing for easy insertion into the bucket 10 tab slot 32*a*.

It should be noted that, during assembly the parts tend to snap automatically toward their required positions. Pressure at the intersection of the fold lines 34 and 35 as indicated by the arrow 43, causes the container bottom to snap lock into position by reversing the natural folded configuration, therefore forcing it to take the shape illustrated in FIG. 4, except for the folding over of tab 29 into its slot 32*a*.

FIG. 5 shows a top view of the bucket 10, looking downward toward the bottom which is shown to be in an undulating, concave configuration. It can easily be seen herein how the tabs 27 and 28 fit through the tabs slots 32*a* and 32*b*. The tabs 27 and 28 can then be folded downward, flush against the panels 22 and 18 and 19 and 15 respectively, locking the bucket 10 in an open position.

Figure 6:
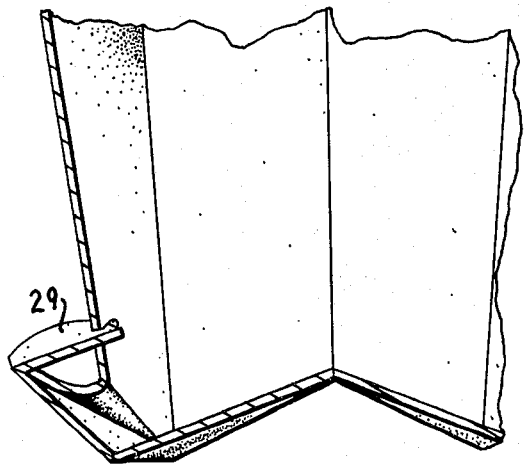
FIG. 6 is a cutaway view of the locking device of FIG. 4.

FIG. 6 is a cross-sectional view of FIG. 4 and illustrates further the angle at which the tab 28*a* is inserted into the tab slot 32*a*. The locking action of the web 30*c* can again be seen herein. It should be noted that the web 30*c* folds over the section of the blank and when locked between the tab panel 28*a* and the panel 19, prevents any leakage of fluid contained in the contents of the container from any point below the tab receiving slots 32*d* and 32*b*.

FIG. 7 illustrates via cross-section, the tab 28 folded flush against the panels 19 and 15. The notches 36*a*, 36*b*, 36*c* and 36*d* lock onto the crotch of the V of the tab slots 32*a* and 32*b*, and then in combination with the folding of the tab 28 at fold line 13*a*, provides a secure locking system. It should be noted that the notches 36*a*, *b*, *c* and *d* or equivalent locking means, are critical in the locking system as they aid in preventing the tab 28 from slipping out.

Although locking projections can be provided on one or both sides of the lower end of each of the tabs 28 and 29, as illustrated in FIG. 8 which shows engagement of a projection 50 with the folded edge 52 of the panel 15, the aforenoted use of notches 36*a*, *b*, *c*, and *d* is preferred, particularly where firm engagement of the tab panels 26 and 28 against the respective side panels is desired.

The term contiguous as employed herein is intended to describe the exact coincidence or common identity of one side of each two panel sections. For example, contiguous panels 19 and 20 share a common side formed by a score line 19, contiguous panels 20 and 21 share a common side 20S formed by a portion of the score line 35, and panels 21 and 22 have a contiguous side formed by a score line 21S. The term score line as employed herein is synonymous with the term fold line.

What is claimed is:

1. A blank capable of rapidly setting-up into a self-supporting container, comprising;
   - an octagonal base panel,
   - at least ten side panels,
   - said side panels including a plurality of center panels in a first contiguous group and a second contiguous group, with each of said center panels being separated from a contiguous side panel by a fold line, and from said base panel by a fold line.
   - said side panels further including a first set of end panels and a second set of end panels, each of said first set and said second set of end panels being panels which do not share a fold line with said base panel, and,
   - said first set of end panels having two glue flap end members contiguous with said first set of end panels, and,
   - linking web means, said linking web means being contiguous with and divided from said end panels by a fold line, and
   - a tab panel means contiguous with said linking means and sharing two fold lines with two sides of said polygonal base panel and,
   - a pair of locking tab means, each of said pair of locking tab means sharing a fold line with its respective tab panel.

2. The structure of claim 1 wherein said first set of glue panels and said second set of glue panels comprise two panels and are at opposite ends of said first contiguous group of side panels.

3. The structure of claim 1 wherein a primary fold line divides said polygonal base and said tab panels into essentially equal halves.

4. The structure of claim 3, further comprising a secondary fold line normal to said primary fold line and dividing each of said first contiguous group and said second contiguous group into essentially equal halves and, in conjunction with the primary fold line divides said polygonal base into four mirror images.

5. The blank of claim 1, wherein said blank is a sheet of fibrous material having a primary grain direction, said primary grain direction being parallel to said second fold line.

6. The structure of claim 1, wherein each of two tab panels have a locking tab means extending outwardly from a peripheral edge and tab slots are positioned in said end panels and said glue panels to receive said locking tab means when said blank is formed into a container.

7. The structure of claim 1, wherein each of said linking webs, are essentially triangular in configuration.

8. The structure of claim 6, wherein each of said tab panels is essentially in the form of a quadrangle.

9. The structure of claim 4, wherein each half has two side panels contiguous with said polygonal base, two end side panels not directly contiguous with said polygonal base and a glue flap side panel contiguous with one of sad two end side panels.

10. A self supporting container formed from the blank of claim 1, wherein each of two glue flaps have been folded over and adhered to an end side panel to form a unitary structure having two essentially identical halves with said polygonal base panel lying in a plane which is approximately perpendicular to the planes of the side panel, said support webs lying in a plane substantially parallel to and adjacent to the proximate region of said polygonal base in supporting relationship thereto.

11. The structure of claim 10, wherein in each set of support webs the common fold line between said webs and said tab panels is at approximately a right angle with the fold line shared by one member of said set of end panels and a support web.

12. The structure of claim 4, wherein said blank has eight side panels.

13. A blank for use in forming a set-up container from a single sheet of material, said blank being divided into a plurality of panels by a plurality of fold lines, comprising:

a first fold line dividing said blank into two halves;

a second fold line normal to said first fold line dividing each of said two halves into two sections;

an octagonal base panel formed by eight fold lines and divided into four equal sections by said first fold line and said second fold line;

a first side member divided by said first fold line into two sections, each of said two sections being divided by a fold line into an center panel and an end panel, each center panel of said first side member having a side contiguous with one side of a first pair of adjacent sides of said octagonal base;

a second side member divided by said first fold line into two sections, each of said two sections being divided by a fold line into an inner panel and an end panel, each inner panel of said second side member having a side contiguous with one side of a second pair of adjacent sides of said octagonal base.

14. A set-up container formed from a blank which is a single sheet of material, said container blank being divided into a plurality of panels by a plurality of fold lines, comprising:

a first fold line dividing said container blank into two halves;

a second fold line normal to said first fold line dividing each of said two halves into two sections;

an octagonal base panel formed by eight fold lines and divided into four equal sections by said first fold line and said second fold line;

a first side member divided by said first fold line into two sections, each of said two sections being divided by a fold line into an center panel and an end panel, each center panel of said first side member having a side contiguous with one side of a first pair of adjacent sides of said octagonal base;

a second side member divided by said first fold line into two sections, each of said two sections being divided by a fold line into an center panel and an end panel, each center panel of said second side member having a side contiguous with one side of a second pair of adjacent sides of said octagonal base;

wherein said set-up container has an open top container having eight vertical sides and a undulating, concave, snaplock bottom.

* * * * *